US008789595B2

(12) United States Patent
Guerrero et al.

(10) Patent No.: US 8,789,595 B2
(45) Date of Patent: Jul. 29, 2014

(54) APPARATUS AND METHOD FOR SAND CONSOLIDATION

(75) Inventors: Julio C. Guerrero, Cambridge, MA (US); Adam Paxson, Boston, MA (US); Folkers Eduardo Rojas, Cambridge, MA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 685 days.

(21) Appl. No.: 13/006,456

(22) Filed: Jan. 14, 2011

(65) Prior Publication Data

US 2012/0181023 A1 Jul. 19, 2012

(51) Int. Cl.
*E21B 43/267* (2006.01)
*E21B 43/02* (2006.01)

(52) U.S. Cl.
CPC ..... *E21B 43/025* (2013.01); *E21B 43/267* (2013.01)
USPC ..... 166/280.1

(58) Field of Classification Search
USPC ..... 166/278, 280.1; 135/126, 128; 446/487, 446/107, 119; 52/81.5, 81.2
See application file for complete search history.

(56) References Cited

U.S. PATENT DOCUMENTS

| | | | | |
|---|---|---|---|---|
| 3,404,735 | A | 10/1968 | Young et al. | |
| 3,779,951 | A | 12/1973 | Streu | |
| 3,916,559 | A * | 11/1975 | Flowerday | 446/487 |
| 5,178,218 | A | 1/1993 | Dees | |
| 5,439,018 | A * | 8/1995 | Tsai | 135/143 |
| 5,531,274 | A | 7/1996 | Bienvenu | |
| 6,082,056 | A * | 7/2000 | Hoberman | 52/81.5 |
| 6,219,974 | B1 * | 4/2001 | Hoberman | 52/81.5 |
| 6,315,791 | B1 | 11/2001 | Gingras et al. | |
| 6,382,319 | B1 | 5/2002 | Hill et al. | |
| 6,752,208 | B1 * | 6/2004 | Nguyen | 166/280.1 |
| 6,866,099 | B2 | 3/2005 | Nguyen | |
| 7,134,501 | B2 | 11/2006 | Johnson et al. | |
| 7,144,844 | B2 | 12/2006 | Qu et al. | |
| 7,267,170 | B2 * | 9/2007 | Mang et al. | 166/279 |
| 7,398,831 | B2 | 7/2008 | Schetky et al. | |
| 7,543,640 | B2 | 6/2009 | MacDougall | |
| 7,624,802 | B2 | 12/2009 | McCrary et al. | |
| 7,631,689 | B2 | 12/2009 | Vinegar et al. | |

(Continued)

FOREIGN PATENT DOCUMENTS

GB 2419614 A 3/2006

OTHER PUBLICATIONS

Hackworth et al., Design Optimization Applied to the Development of an Oilfield Bistable Expandable Sand Screen, Altair Engineering, Altair Technology Conference 2004, pp. 9-1 to 9-23.

(Continued)

*Primary Examiner* — Nicole Coy
(74) *Attorney, Agent, or Firm* — Bridget Laffey; Jakub M. Michna

(57) ABSTRACT

An apparatus and method for preventing the migration of unconsolidated and/or loosely consolidated material into the wellbore. Such prevention is accomplished by introducing a well treatment comprising an expandable deployable structure into an uncosolidated zone proximate the wellbore. These deployable structures are inserted into the voids of the geological formation and using stored mechanical energy convert from an unexpanded or undeployed state to an expanded or deployed state. These deployable structures can exert forces, pressure or a combination of both in multiple directions on the surrounding media.

23 Claims, 6 Drawing Sheets

(56) References Cited

U.S. PATENT DOCUMENTS

| | | | | |
|---|---|---|---|---|
| 7,632,300 | B2 | 12/2009 | Thompson | |
| 7,673,686 | B2 | 3/2010 | Nguyen et al. | |
| 7,677,321 | B2 | 3/2010 | Spray | |
| 7,798,222 | B2 | 9/2010 | Wilson | |
| 7,814,980 | B2 | 10/2010 | Bryant et al. | |
| 7,832,490 | B2 | 11/2010 | Willauer | |
| 7,836,952 | B2 * | 11/2010 | Fripp | 166/280.1 |
| 7,896,088 | B2 * | 3/2011 | Guerrero et al. | 166/382 |
| 7,926,565 | B2 | 4/2011 | Duan et al. | |
| 2006/0037745 | A1 | 2/2006 | Hart et al. | |
| 2008/0099200 | A1 | 5/2008 | Wilson | |
| 2009/0014178 | A1 | 1/2009 | Kotlar et al. | |
| 2010/0089565 | A1 | 4/2010 | Duan et al. | |
| 2011/0132626 | A1 * | 6/2011 | Guerrero et al. | 166/387 |
| 2012/0247761 | A1 * | 10/2012 | O'Malley | 166/278 |
| 2013/0025215 | A1 * | 1/2013 | Guerrero et al. | 52/81.2 |

OTHER PUBLICATIONS

Hackworth et al., "Development and First Application of Bistable Expandable Sand Screen", presented at the SPE Annual Technical Conference and Exhibition held in Denver, CO, Oct. 5-8, 2003, pp. 1-14.

Ott et al., Chapters 1 to 3, "World Oil: Modern Sandface Completion Practices Handbook", 2003, First Edition, Gulf Publishing Company, Houston, pp. 1-101.

* cited by examiner

APPARATUS AND METHOD FOR SAND CONSOLIDATION

FIELD OF THE DISCLOSURE

The subject disclosure relates generally to apparatus and methods for treating loosely consolidated and/or unconsolidated subterranean formations. More particularly, the subject disclosure relates to apparatus and methods for reducing or precluding the migration of fines and sand with the fluids produced from such wells without obstructing the borehole.

BACKGROUND OF THE DISCLOSURE

Any porous media, whether it is granular or continuous, is subjected to a space- and time-variant stress field. This stress field determines the behavior of the geological formation, and depending on the stress state of the geological formation, the geological formation may exhibit very different phenomena.

Operations performed on the porous media may lead to changes in the stress field. This change in the stress field may result in problems such as sand production seen in the recovery of hydrocarbons. The removal of hydrocarbons from a rock formation causes a deterioration of the stress field and results in the loosening of the formation next to the wellbore. The production of such sand or formation material along with production fluids tends to cause erosion and/or plugging of production equipment, substantially increasing the costs of well operation.

Current methods of altering the stress field of geological formations include resin consolidation. U.S. Pat. No. 3,404,735, entitled "Sand Control Method" and U.S. Pat. No. 5,178,218, entitled "Methods of Sand Consolidation with Resin", disclose using resins to form permeable consolidated zones around wells. In general, a curable resin, often a thermosetting polymer, is injected into a wellbore and caused to harden thus consolidating the solids into a hard permeable mass. The resin forms a coating around individual particles and binds the particles together, which increases the yield strength of the geological formation. As a result, the stress field becomes more uniform as the formation is able to distribute loads into the newly consolidated portions and sand production may be reduced. One of the difficulties encountered during the implementation of resin consolidation is unintended plugging of certain low-permeability regions of the formation. A further difficulty encountered may be poor adhesion between particles which detracts from the effectiveness of resin consolidation.

A further approach to altering the stress field of the formation involves high-pressure injection of incompressible materials. Common materials utilized are water, gravel and specialized fluid/proppant mixtures. U.S. Pat. No. 6,382,319, entitled "Method and Apparatus for open hole gravel packing" discloses an open hole gravel packing system wherein a positive hydrostatic pressure differential within the wellbore is maintained against the production formation walls throughout all phases of the gravel packing procedure. U.S. Pat. No. 5,531,274, entitled "Lightweight proppants and their use in hydraulic fracturing" discloses lightweight proppants and U.S. Pat. No. 7,144,844, entitled "Method of using viscoelastic vesicular fluids to enhance productivity of formations" discloses the use of viscoelastic fluids, such as diverter fluids in matrix acidizing, fracturing fluids and fluids for sand control completion. One of the difficulties with these methods is the significant cost associated with high-pressure injection. A further significant problem is the risk associated with failure of the well equipment.

However, there still remains a need for improved apparatus and methods for consolidating, or at least partially consolidating production formations to prevent the migration of sand material along with production fluids from a production formation while at the same time maintaining permeability in the production zone.

SUMMARY OF THE DISCLOSURE

In accordance with one embodiment of the subject disclosure a plurality of deployable structures are injected into the voids between individual particles in a geological formation. Once the deployable structures are inserted into the voids of the media and triggered to exert forces the stress field of the geological formation may be altered.

According to one aspect of the subject disclosure, an apparatus having an un-deployed state and a deployed state is disclosed. The apparatus comprises a plurality of members and a flexure disposed along the length of each of the plurality of members. Adjacent members of the plurality of members are joined at a vertex and the flexure is adapted to translate radially outward.

In accordance with a further embodiment of the subject disclosure, a method of deploying an apparatus which comprises an un-deployed state and a deployed state is disclosed. The method comprises a first step of providing a plurality of members having a flexure disposed along the length of each of the plurality of members. The method further comprises the step of joining adjacent members of the plurality of members at a vertex and actuating the flexures between the un-deployed and deployed state or vice versa.

Further features and advantages of the subject disclosure will become more readily apparent from the following detailed description when taken in conjunction with the accompanying drawings.

DETAILED DESCRIPTION

Figure 1B:
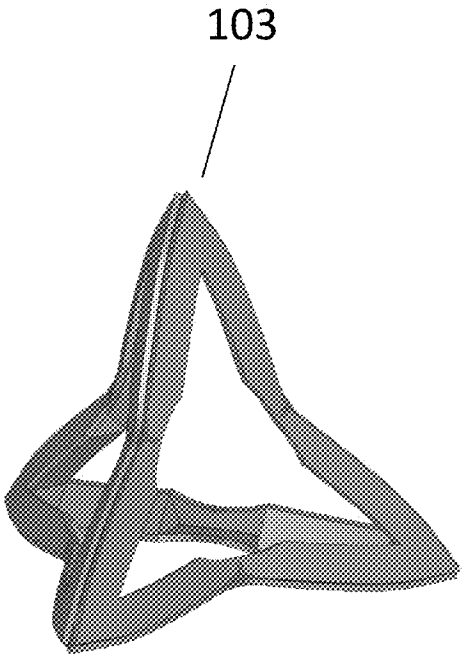
FIGS. 1A and 1B depicts an embodiment of the subject disclosure in an un-deployed or an unexpanded state and a deployed or expanded state, respectively.

Embodiments herein are described with reference to certain types of deployable structures. The subject disclosure relates to a mechanical system that utilizes stored mechanical potential energy to change its configuration from an un-deployed or unexpanded state to a deployed or expanded state. The mechanical system may be triggered to release this stored energy at a specific moment to achieve a desired geometric configuration and strength. The mechanical system may be designed to fill voids in porous media, in one non-limiting example to fill voids in porous media in sandstone. The mechanical conformation may be changed resulting in the mechanical system exerting forces, pressure or a combination of both in multiple directions on the surrounding media. The direction, magnitude, timing and rate of the forces, pressure, or a combination of both can be pre-determined and controlled.

An embodiment of the subject disclosure comprises an energy storage module, one or a plurality of geometric configurations, a triggering mechanism and one or a plurality of sizes. Further, embodiments of the subject disclosure disclose injecting a plurality of deployable structures into voids between individual particles in a geological formation. These voids have an approximate size of 1 e-4 $mm^3$ to 1 $mm^3$ in volume. One of the advantages of the subject disclosure is the ability of the deployable structures to adjust to the size of the voids. There are a number of micrometer-scale deployable structures available which include thermally actuated microspheres with diameters ranging from 1 μm to 50 μm (See U.S. Pat. No. 3,779,951, entitled "Methods for expanding microspheres and expandable composition"). In general, these devices consist of a liquid hydrocarbon enclosed by a thermoplastic shell. The application of heat to the device causes considerable thermal expansion of the liquid hydrocarbon and a weakening of the thermoplastic shell thus allowing the device to expand. The materials are not suitable for altering the stress field of a rock formation as they cannot exert the forces necessary.

A further group of small-scale deployable structures are expandable stents which are used to restore patency to occluded blood vessels. These structures are often constructed from shape memory alloys e.g. Nitinol. Nitinol undergoes a conformation change upon exposure to a critical transition temperature. The nitinol alloy undergoes a change in crystal structure thus allowing the stent to deploy from a low-volume insertion configuration to a larger deployed configuration. One of the disadvantages of this technology is the smallest size attainable from these configurations is on the order of a few millimeters which renders these devices to large for insertion into porous formations. The subject disclosure discloses deployable structures which have the ability to adjust to void sizes of approximately 1 e to 4 $mm^3$ to 1 $mm^3$ in volume.

One embodiment of the subject disclosure comprises a device having a three-dimensional assembly of load-bearing members. These load-bearing members have the ability to support large loads and/or pressure which may be exerted by the surrounding media in which the device is inserted. The device can assume one of two conformational states; a deployed state or expanded state or an un-deployed state or unexpanded state. In the un-deployed state the device can store energy which when released allows the device to transform to a deployed state.

The device occupies a volume in its deployed state which is different from its un-deployed state and one advantage of this device is that this volume change is substantially greater than by utilizing thermal effects. The device changes from an un-deployed state to a deployed-state by application of an external trigger which results in a volume change and an application of forces on the surrounding media. The force, load and displacement response of the subject disclosure may be adjusted in different ways, in one non-limiting example, the force, load and displacement response is adjusted by varying the dimensions of the members. The cross-sectional area of the load-bearing members may be altered to vary the stiffness of the members. The force the device is able to withstand in a geological formation can be varied by altering the stiffness of the load-bearing members. As a result of altering the stiffness of the load-bearing members the device is able to withstand different force requirements in a geological formation.

In one non-limiting embodiment of the subject disclosure the device is a mechanical system and uses stored mechanical potential energy to change its configuration from an un-deployed state or unexpanded state to a deployed state or expanded state. In one non-limiting example the device is a 3-D deployable structure. Further, in one non-limiting example the 3-D deployable structure is a tetrahedron, although other geometric configurations are contemplated.

Figure 1A:
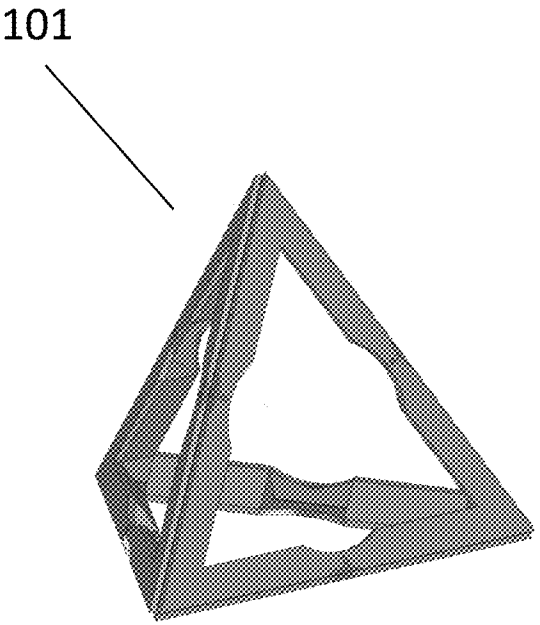

FIGS. 1A and 1B depict an embodiment of the subject disclosure in an un-deployed or an unexpanded state and a deployed or expanded state, respectively. In one non-limiting example the device (101) is by default expanded as depicted in FIG. 1A. The device (103) in its unexpanded or un-deployed state or retracted state as depicted in FIG. 1B stores potential energy. When the stored energy is released the device deforms towards the default state and in the default state the device can exert forces, pressure, or a combination of both in multiple directions on the surrounding media.

The subject disclosure can trigger the release of stored energy at a specific moment to achieve a predetermined geometric configuration and strength. In one non-limiting example the release of stored energy is triggered by a temperature change in the surrounding media where the device is deployed. Other triggers which lead to the release of energy by the device are contemplated in the subject disclosure and include electromagnetic triggers, chemical triggers, magnetic field triggers or electric field triggers.

In a further embodiment of the subject disclosure the device may be implemented with bi-stable components. These "bi-stable components," are components that can be selectively disposed in either of two different, stable configurations thus allowing devices of the subject disclosure to change state and transform from a deployed structure to an un-deployed structure or from an un-deployed structure to a deployed structure using the devices two states. The device has two or more stable configurations, including a first stable configuration with a first volume and a second stable configuration with a second, larger volume.

Embodiments of the subject disclosure may be built using a variety of materials. Materials may be selected based on the media that the devices will be deployed in and on the forces the device may need in a certain media. In one non-limiting example, the device may be built with memory alloys. One non-limiting material for forming a device is a self-expanding material such as the superelastic nickel-titanium alloy sold under the tradename NITINOL. Materials having superelastic properties generally have at least two phases: a martensitic phase, which has a relatively low tensile strength and which is stable at relatively low temperatures, and an austenitic phase, which has a relatively high tensile strength and which may be stable at temperatures higher than the martensitic phase. Shape memory alloys undergo a transition between an austenitic phase and a martensitic phase at certain temperatures. When they are deformed while in the martensitic phase, they retain this deformation as long as they remain in the same phase, but revert to their original configuration when they are heated to a transition temperature, at which time they transform to their austenitic phase. The temperatures at which these transitions occur are affected by the nature of the alloy and the condition of the material.

Embodiments of the subject disclosure may have varying geometric characteristics. These geometric characteristics may be chosen to enable the devices to perform different levels of load displacement. In non-limiting example, these geometric characteristics are the lengths of the load-bearing members, cross-sections of the arms and the topology, although other geometric characteristics are contemplated. In one non-limiting example the topology is a tetrahedron. FIG. 1A and FIG. 1B depict one embodiment of the subject disclosure as a tetrahedron. The size of the device is in the order of magnitude of sandstone grains found in the downhole formations. In one non-limiting example, the size of the device is about 1 e to 4 $mm^3$ to 1 $mm^3$.

Embodiments of the subject disclosure may be locked in place in the expanded state. In one non-limiting example, a mechanical lock may be used to lock the device in the expanded state. In other examples the removal of a trigger or the conditions that triggered the energy release from the device may lock the device in the expanded state. Finally, chemical substances may be used to modify the reversibility of the device, thus, locking the device.

Figure 2B:
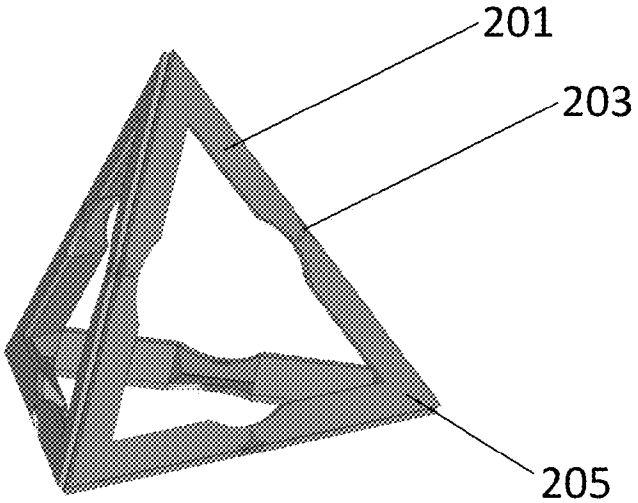
FIG. 2B is an isometric view of an embodiment of the subject disclosure in its deployed or expanded state.
Figure 2A:
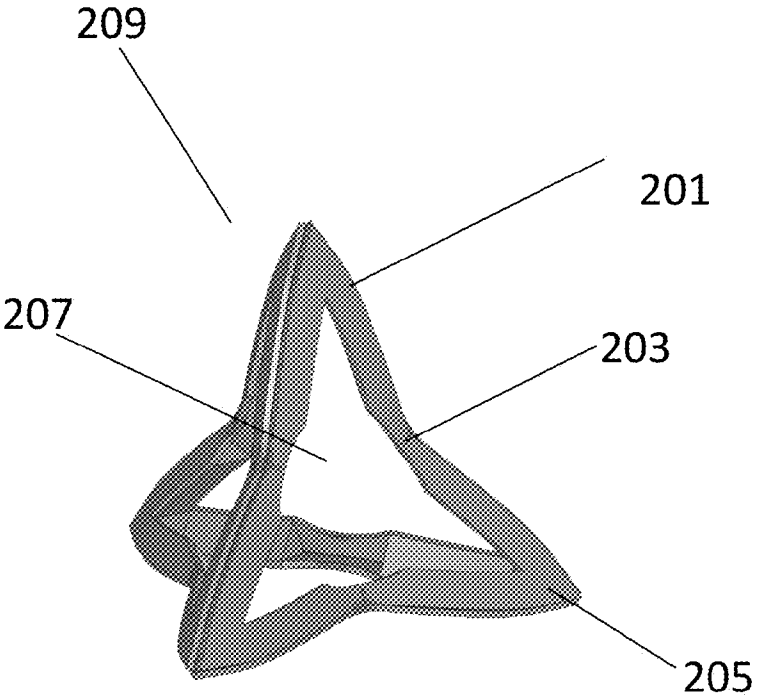
FIG. 2A is an isometric view of an embodiment of the subject disclosure in its un-deployed or unexpanded state.

Embodiments of the subject disclosure, in non-limiting examples may be used for sand control in a wellbore or may be used as proppants inside a formation. Referring to FIG. 2A and 2B which depict an embodiment of the subject disclosure. The device comprises an energy storage module, a selected geometric configuration e.g. tetrahedron, a selected trigger and a selected size. The features of the device are selected based on where the device will be deployed. FIGS. 2A and 2B depict a device (209) comprising a plurality of load-bearing members (201) in an unexpanded state in FIG. 2A and an expanded state in FIG. 2B. Each of the plurality of load-bearing members (201) includes a flexure (203). The flexure (203) is located along a portion of the length of the load-bearing members (201). These flexures (203) can deform locally and act as an energy storage element. Adjacent members are joined at vertex (205). The local deformation of the flexures (203) results in an overall deformation of the device (209) as shown in FIG. 2B. The six flexures (203) translate radially outward from the device centroid (207) thus forming the deformed state of the device.

In embodiments of the subject disclosure the deformed state as depicted in FIG. 2A is the un-deployed state. In the un-deployed state the device stores energy. FIG. 2B depicts the deployed state. In the deployed state, loads or pressures are exerted on the formation. Media in the formation that contact the device (209) are subjected to forces from the vertices (203), load-bearing members (201) and flexures (203). The directions and magnitudes of load, pressure and displacement, exerted by the deployed or un-deployed device (209) may be predetermined and controlled. These forces, and other forces contemplated by those skilled in the art, when divided by the area of an exosphere containing the four vertices (203) result in a pressure P exerted by the device (209). In a further embodiment of the subject disclosure the deployed and un-deployed states operate in reverse with the device in the deployed state storing energy. The volume occupied by the deployed device as seen in FIG. 2B, as measured by a solid tetrahedron containing six vertices (203), is larger than the volume of the un-deployed device as seen in FIG. 2A.

Figure 3:
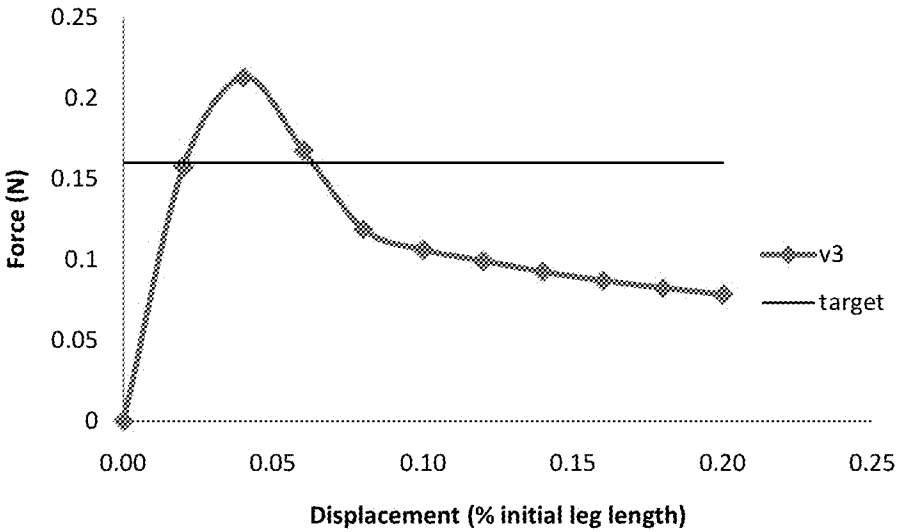
FIG. 3 depicts a force-displacement response for an embodiment of the subject disclosure.

FIG. 3 depicts a force-displacement response for an embodiment of the subject disclosure. Embodiments of the subject disclosure are able to exert forces against the surrounding media by releasing the energy stored in the one or plurality of flexures. The device stores energy in the flexures by pre-forming to its un-deployed state. External forces are applied against the one or plurality of flexures so that the flexures undergo plastic deformation. As the one or plurality of flexures deform, they store energy according to Hooke's law (where the energy is equal to half of the structure stiffness times the square of the displacement of the vertex). The stiffness of the device (156 N/μm) is indicated in FIG. 3 by the initial slope of the force-displacement curve as generated by a computer simulation. The displacement delta was calculated as the overall change in height as all four vertices are displaced radially outward from the centroid.

Figure 4:
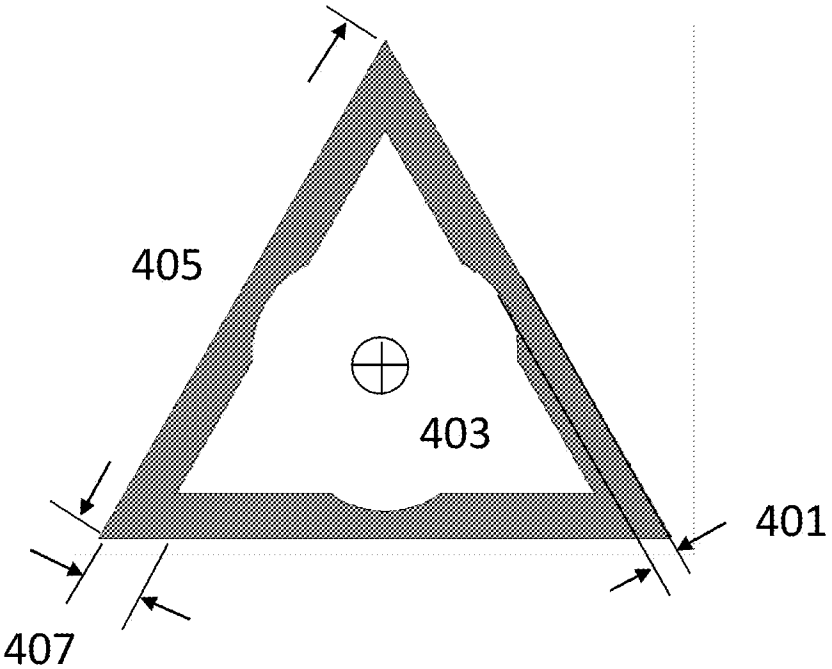
FIG. 4 depicts a plan view of a two-dimensional profile for an embodiment of the subject disclosure.

FIG. 4 depicts a plan view of a two-dimensional profile. In an exemplary embodiment, the leg length (405) is 100 μm. The volume of the device in the un-deployed state is less than 90% of the volume in the deployed state, approximately $1.178*10^{-13}m^3$. The volume of the device may be adjusted to accommodate the porous media in which the device is inserted. Further, the stiffness, or strength of the device may be varied in one or a plurality of different ways. In one non-limiting example, the dimensions as shown in FIG. 4 may be adjusted. In non-limiting examples, these dimensions include, but are not limited to, member length (405), member width (407), flexure thickness (401) and profile extrusion thickness normal to the plane of the figure.

Figure 5:
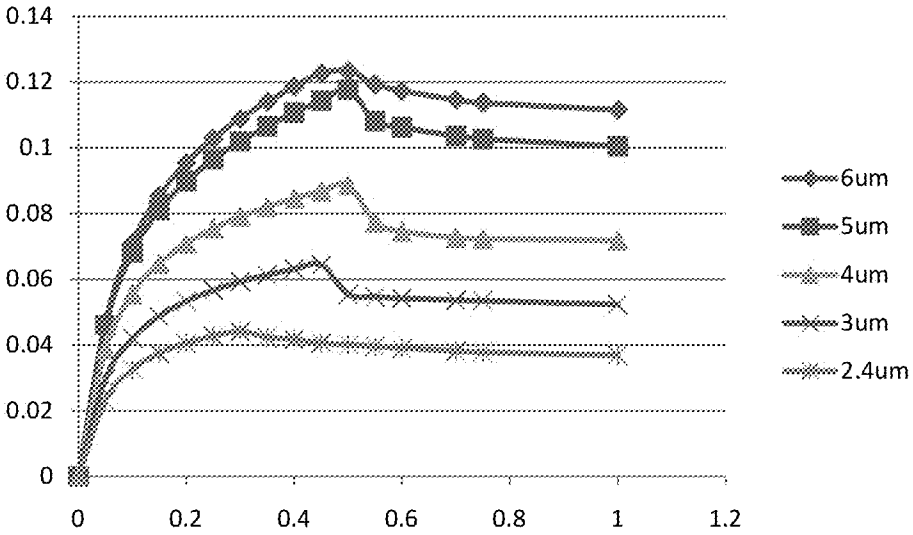
FIG. 5 depicts a force-displacement response for an embodiment of the subject disclosure as a dimension is varied.

FIG. 5 depicts the force-displacement response of the device as one of the dimensions is varied. In particular, FIG. 5 is an example of the stiffness variation as a function of profile thickness generated by a computer simulation.

Figure 6:
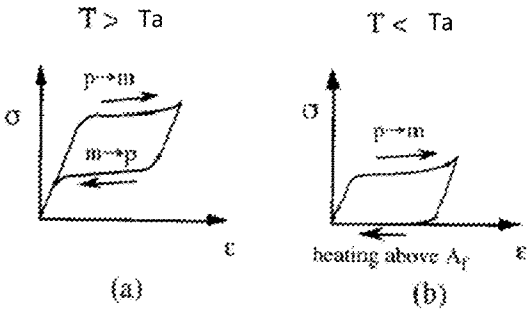
FIG. 6 depicts a stress-strain response of an alloy used in an embodiment of the subject disclosure.

Embodiments of the subject disclosure may comprise shape memory alloys. Shape memory alloys (SMA's) generally refer to a group of metallic materials that demonstrate the ability to return to some previously defined shape or size when subjected to an appropriate thermal stimulus. Shape memory alloys are capable of undergoing phase transitions in which their yield strength, stiffness, dimension and/or shape are altered as a function of temperature. The term "yield strength" refers to the stress at which a material exhibits a specified deviation from proportionality of stress and strain. Generally, in the low temperature, or martensite phase (m), shape memory alloys can be plastically deformed and upon exposure to some higher temperature will transform to an austenite phase, or parent phase (p), returning to their shape prior to the deformation. Materials that exhibit this shape memory effect only upon heating are referred to as having one-way shape memory. Shape-memory alloys, in one non-limiting example, Nitinol is a nickel-titanium shape memory alloy, which can be formed and annealed, deformed at a low temperature, and recalled to its original shape with heating. Nitinol, has the ability to recover a large amount of plastic deformation upon exposure to a temperature above the Austenitic transition temperature $T_A$. The value of $T_A$ is determined by the relative percentages of nickel and titanium in the alloy and may be adjusted to lie anywhere within a large temperature range. Below this temperature, any plastic deformation of the alloy results in the formation of a martensitic crystal phase within the metal's atomic lattice. On heating the material above $T_A$ the martensitic areas become unstable and these areas revert back to their original austenitic phase. As this happens, the material deforms back to the original configuration before the plastic deformation was applied. FIG. 6 depicts the stress-strain response of Nitinol at different temperatures. The martensite start temperature (Ms) is the temperature at which the transformation from austenite to martensite begins on cooling. The martensite finish temperature (MO is the temperature at which the transformation from austenite to martensite finishes on cooling. The austenite start temperature (As) is the temperature at which the transformation from martensite to austenite begins on heating. The austenite finish temperature (AO is the temperature at which the transformation from martensite to austenite finishes on heating.

On reviewing the figure it can be seen that the unloading curve for temperatures above $T_A$ returns to the original strain value, whereas the unloading curve for temperatures below $T_A$ exhibits permanent plastic deformation. In order to utilize the shape memory effect of the Nitinol alloy, embodiments of the subject disclosure are pre-formed into the un-deployed state at temperatures below $T_A$. Embodiments of the subject disclosure are then conveyed into the porous media, utilizing any of the various methods known to those skilled in art. Embodiments of the subject disclosure are conveyed into the porous media at temperatures below $T_A$ and are triggered in the porous media by exposure to temperatures above $T_A$.

While the subject disclosure is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the subject disclosure should not be viewed as limited except by the scope and spirit of the appended claims.

What is claimed is:

1. A wellbore apparatus deployed into one or a plurality of voids between particles in a subterranean formation having an un-deployed state and a deployed state, the apparatus comprising:

a plurality of load bearing members;

a flexure disposed along the length of each of the plurality of load bearing members; and wherein adjacent members of the plurality of load bearing members are joined at a vertex and the flexure is adapted to translate radially outward.

2. The apparatus of claim 1 wherein the apparatus has a tetrahedron shape.

3. The apparatus of claim 1 wherein the flexure stores energy in the un-deployed or deployed state.

4. The apparatus of claim 3 wherein the flexures are deformed by releasing the stored energy.

5. The apparatus of claim 4 wherein the stored energy is mechanical.

6. The apparatus of claim 4 wherein the stored energy is released by a triggering mechanism.

7. The apparatus of claim 6 wherein the triggering mechanism is an increase or decrease in temperature.

8. The apparatus of claim 6 wherein the triggering mechanism is chemical.

9. The apparatus of claim 1 wherein the plurality of load bearing members comprise a shape memory alloy.

10. The apparatus of claim 9 wherein the shape memory alloy is nitinol.

11. The apparatus of claim 1 wherein the plurality of load bearing members comprise a bi-stable material to actuate the apparatus between un-deformed and deformed configurations or vice versa.

12. The apparatus of claim 1 wherein a default state is the deployed state.

13. The apparatus of claim 1 wherein a change of state from an un-deployed state to a deployed state leads to a volume change.

14. The apparatus of claim 1 wherein the volume of the apparatus in the un-deployed state is less than about 90% of the volume in the deployed state.

15. The apparatus of claim 1 wherein the apparatus may be locked in place in the deployed state.

16. The apparatus of claim 15 wherein the apparatus may be locked in place by a mechanical lock.

17. The apparatus of claim 1 wherein the deployed state alters a stress field in the subterranean formation.

18. The apparatus of claim 1 wherein an average void size between individual particles is about 1e-4 $mm^3$ to 1 $mm^3$ in volume.

19. The apparatus of claim 1 wherein a volume change is equal to the average void size between individual particles.

20. The apparatus of claim 1 wherein the deployed state exerts pressure on the surrounding subterranean formation.

21. The apparatus of claim 20 wherein the pressure exerted is controlled by varying the dimensions of the plurality of load bearing members.

22. A method of deploying an apparatus in a wellbore, the apparatus comprising an un-deployed state and a deployed state, the method comprising:

deploying the apparatus into a plurality of voids between particles in a subterranean formation;

providing a plurality of load bearing members having a flexure disposed along the length of each of the plurality of load bearing members;

joining adjacent members of the plurality of load bearing members at a vertex; and actuating the flexures between the un-deployed and deployed state or vice versa.

23. A wellbore apparatus deployed into one or a plurality of voids between particles in a subterranean formation having an un-deployed state and a deployed state, the apparatus comprising:

a plurality of load bearing members;

a flexure disposed along the length of each of the plurality of load bearing members; and wherein adjacent members of the plurality of load bearing members are joined at a vertex and the flexures are deformed between the un-deployed and deployed state or vice versa.

* * * * *